US005205445A

United States Patent [19]

Bravin

[11] Patent Number: 5,205,445

[45] Date of Patent: Apr. 27, 1993

[54] DEVICE FOR WASHING MACHINES TO CONTROL THE INTRODUCTION OF DETERGENT

[75] Inventor: Daniele Bravin, Azzano X, Italy

[73] Assignee: Zanussi Elettrodomestici S.P.A., Pordenone, Italy

[21] Appl. No.: 806,050

[22] Filed: Dec. 12, 1991

[30] Foreign Application Priority Data

Dec. 14, 1990 [IT] Italy ..... 45777 A/90

[51] Int. Cl.[5] ..... A47L 15/46

[52] U.S. Cl. ..... 222/651; 68/17 R

[58] Field of Search ..... 222/651, 192; 68/17 R; 200/DIG. 21

[56] References Cited

U.S. PATENT DOCUMENTS

| | | | |
|---|---|---|---|
| 4,149,654 | 4/1979 | Nelson et al. | 222/651 |
| 4,932,227 | 6/1990 | Hogrefe | 222/651 X |
| 5,063,757 | 11/1991 | Ikeda et al. | 68/17 R |

*Primary Examiner*—Gregory L. Huson

*Attorney, Agent, or Firm*—Pearne, Gordon, McCoy & Granger

[57] ABSTRACT

A device for washing machines to control the introduction of detergent. It is intended especially for washing machines and combined machines for the washing and drying of laundry, which have a microprocessor and a distributor with several separate compartments for the detergents and additives to be introduced into the machine tub during the laundry-washing cycle, and which are equipped as well with a selector 13 that may be set to the several compartments by means of two jointed levers 15 and 16. One such lever 15 is associated with two PTC sensors 20 and 21 containing wax which is heated when such sensors are powered. According to the invention, the device includes the connection of the PTC sensors 20 and 21 to a triac 32 powered by the machine electric circuit through a diode 34 and 35 for the purpose, so as to allow one, the other, or both PTC sensors 20 and 21 to be turned ON for every positive or negative half-wave of the electric current. This, in turn, causes the displacement of the selector 13 by means of the levers 15 and 16 to the corresponding regulatory position. A device made in this way proves to be simple and operationally reliable.

1 Claim, 2 Drawing Sheets

DEVICE FOR WASHING MACHINES TO CONTROL THE INTRODUCTION OF DETERGENT

BACKGROUND OF THE INVENTION

1. FIELD OF THE INVENTION

The invention concerns a control device for washing machines, laundry-washing machines in particular, combined with a detergent distributor for the machines, which is capable of selectively regulating the introduction of several detergents into the machines tub for the prewash and washing of laundry contained therein.

2. DESCRIPTION OF RELATED ART

Detergent distributors are known for washing machines such as laundry-washing machines or combined machines for the washing and drying of laundry. They are divided into several separate compartments containing the detergent the prewash, washing and bleaching and/or softening of the wash. In detergent distributors of this type, every compartment may be fed water from the main water supply through a suitable rotating selector that may be set by means of appropriate levers actuated by the machines programmed timer to several positions of operation. In this way, they determine the introduction into the tub of water and detergent or additive respectively contained in such compartment.

Also known are detergent distributors for electronic washing machines equipped with a microprocessor to control the action of the various washing cycles. Detergent distributors of this type are also normally equipped with a rotating selector of the kind mentioned above, which is set to each of its several regulating positions by two small pistons connected to the rotating selector. Each such piston contains wax that can be heated by a PTC element powered electrically through a semiconductor switch suitable for that purpose, such as a triac or similar device connected to the electric circuit of such a machine and to said microprocessor. In this way, the rotating selector of such detergent distributors is set to its various regulation positions by means of the microprocessor. This determines the introduction into the tub of the detergent or additive contained in the specific compartment. The PTC elements are kept ON or OFF or selectively ON by means of the triac by reason of the different heat expansion of the wax of the two small pistons brought about by these ON and OFF switchings of the PTC elements.

SUMMARY OF THE INVENTION

The present invention is intended to achieve a detergent distribution of the kind described above, by means of a simplified and operationally reliable construction of the working parts of the rotating selector. The present invention provides a control device associated with a rotating selector including a series of jointed levers which are operable to set the rotary selector to various regulatory settings. The jointed levers are associated with a pair of box-like housings containing wax which is heatable by a heating element which is powered from the machines electric circuit through a semiconductor switch in conjunction with a pair of oppositely-conducting diodes.

BRIEF DESCRIPTION OF THE DRAWINGS

The invention will be better clarified by the following description, which is intended only to be an example and in no way limitative, referring to the attached drawings, in which.

DETAILED DESCRIPTION OF THE PREFERRED EMBODIMENT

Figure 1:
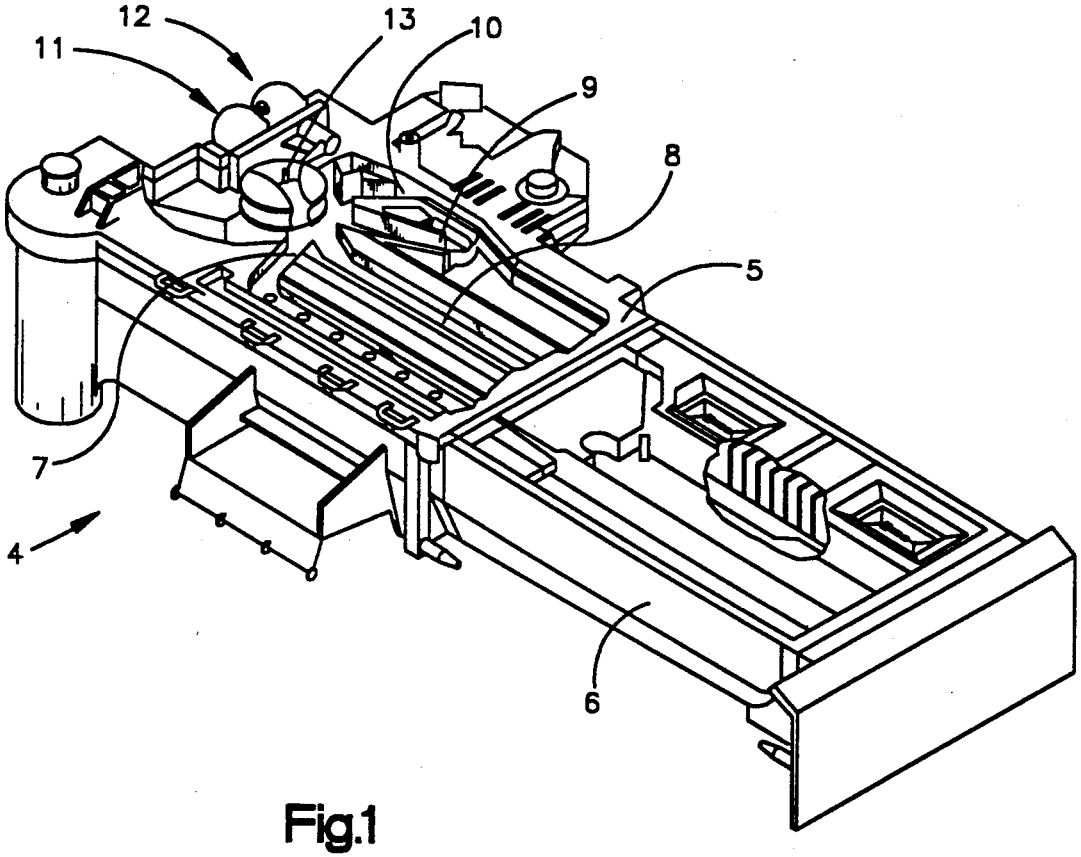
FIG. 1 shows a cross-sectional view of a detergent distributor for washing machines associated with a control device conforming with the invention.

A detergent distributor 4 is schematically represented in FIG. 1. It is installed, as usual, in the upper part of a washing machine, such as a laundry-washing machine or a combined laundry-washing and drying machine. The detergent distributor 4 is constituted by a flat conveyor element 5 and by a drawer 6 having several separate compartments to contain various detergents and/or additives to be introduced selectively into the machines tub to effect the various laundry-washing cycles, the drawer being insertable by slide action into a space made in the front of the washing machine, under the conveyor element 5.

Figure 2:
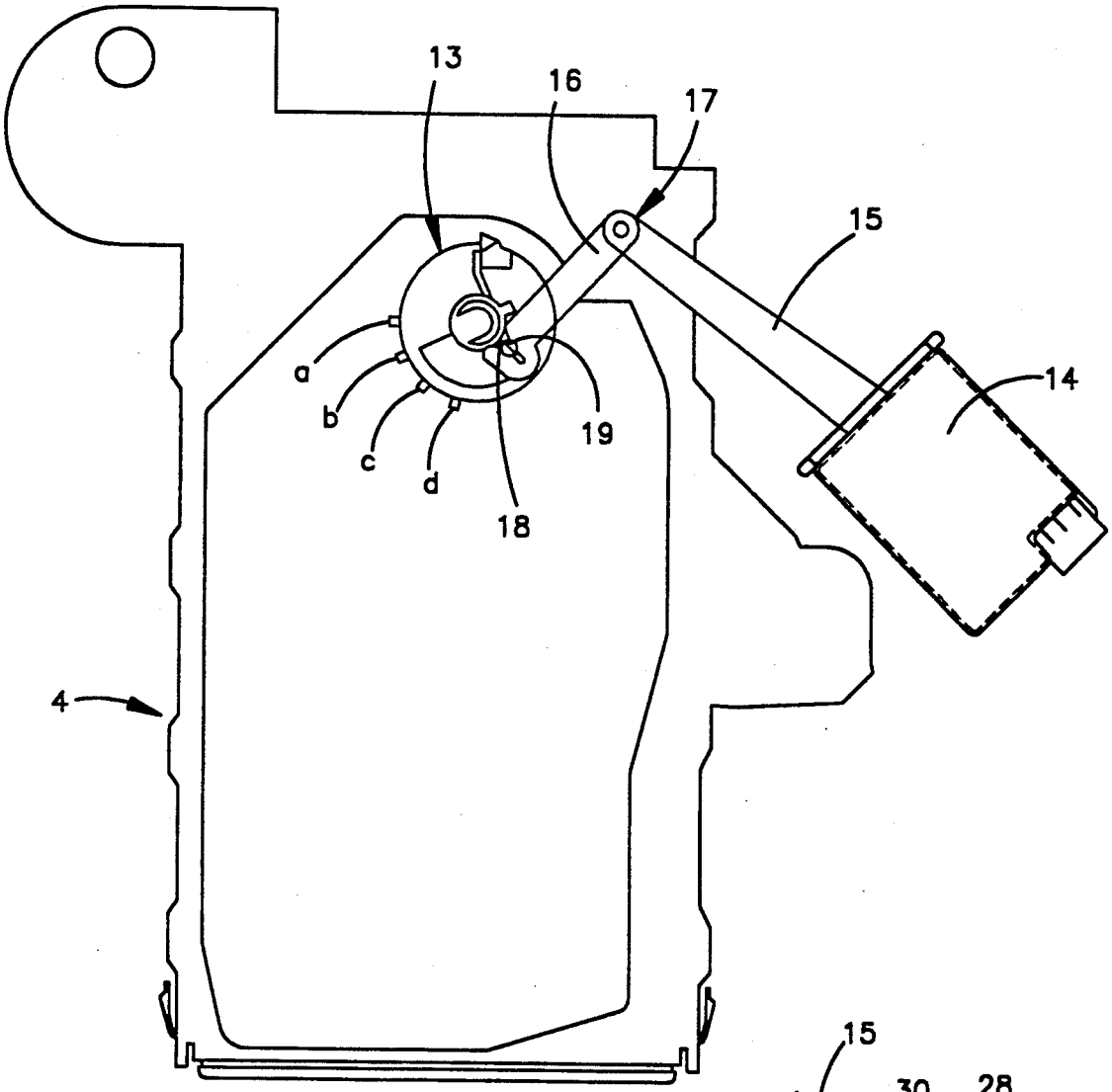
FIG. 2 shows a plan view of the distributor of FIG. 1 with the working parts of the rotating selector of such distributor; and, FIG. 3 schematically illustrates a control device conforming with the invention associated with the working parts of FIG. 2.

As is visible, separate ducts 7, 8, 9 and 10 have been made internally in the flat conveyor element 5 which intercommunicate with the compartments of the drawer 6 underneath. The ducts may be selectively fed cold or hot water coming, respectively, from the ducts 11 and 12 made in the rear part of the conveyor element 5 and connected with the machines electric valve on the inlet line (not shown), by means of a rotating selector 13 placed between ducts 11 and 12 and ducts 7, 8, 9 and 10. The rotating selector can also be set to the various regulatory positions (in this case, to the four positions marked with the letters a, b, c and d, as shown in FIG. 2) by a working part consisting of a small piston 14 and by two levers 15 and 16, jointed at point 17. Lever 15 is jointed at its other end within the piston 14 and is driven in a manner to be hereafter described. The shorter lever 16 has a notch 18 at its other end in which the corresponding pin 19 protruding from the rotary selector 1 is engaged.

Figure 3:
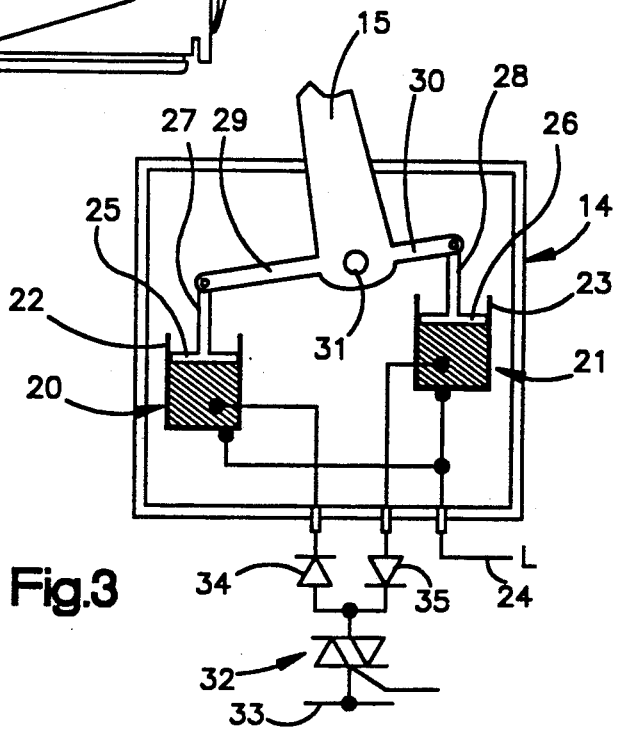

With reference to FIG. 3, it is noted that housed within the small piston 14 there are at least two PTC sensors 20 and 21 whose metal, box-like housings 22 and 23 are hollow and contain wax. In addition, they are connected by phase conductor 24 with the machines electric circuit. The PTC sensors are each equipped with a flat metal element 25, 26 applied to the open end of the box-like housing and connected at right angles to a straight metal piece 27, 28, jointed with a lateral extension 29, 30 placed at the free end of the lever 15, which in turn is jointed at a point 31 inside the small piston 14.

The subject control device is constituted substantially by a semiconductor switch such as a triac 32 or similar uni-directional conductor, connected to a neutral conductor 33 of the machine's electric circuit and to its terminal of the PTC sensors 20 and 21, through at least one single-direction conductor such as a diode 34, 35. Each of the single-direction conductors is polarized in the opposite conduction direction to that of the remaining part. In this way, during every positive or negative half-wave of the alternating electric current through the triac 32, only the diode polarized to conduct such a half-wave is activated, while at the same time, the other diode is kept inactive.

Under these circumstances, the current passing through every PTC sensor determines the rapid heating of the sensor and of the wax contained in the respective box-like housing. The current also determines a corresponding heat expansion of the metal parts associated with this PTC sensor, and, consequently, the shift of the lever 15. Thus, the shifting of the levers 15 and 16 causes the angular shift of the rotating selector 13 to the respective regulatory setting.

Depending on the conduction or inactive state of the two diodes 34 and 35, it is possible to determine, in the manner described, the shift of the rotary selector 13 to the several operating settings, with the consequent introduction into the tub of the detergents contained in the compartments that are respectively selected by such rotating selector.

This state of conduction or inactivity is governed as well by the machines microprocessor (not shown), connected operationally into the machines electric circuit. Such microprocessor thus automatically controls the course of the respective wash cycles imposed on the machine.

In particular, in this example it is possible to obtain the following combinations:

- turn ON the triac with the currents positive half-wave, in which case diode 35 conducts, PTC sensor 21 is powered, and the wax is heated, while diode 34 is inactive and PTC sensor 20 is cold;
- keep the triac switched OFF, thereby keeping both diodes inactive and both PTC sensors cold;
- turn ON the triac with the entire current wave, in which case both diodes conduct, both PTC sensors are powered and both waxes are heated;
- turn ON the triac with the current's negative half-wave, in which case diode 34 conducts, PTC sensor 20 is powered and the respective wax is heated, while the diode 35 is inactive and PTC sensor 21 is cold.

In this way the control device conforming to the invention turns out to be simpler in construction than that previously used, in that it allows the use of a single costly component such as the triac rather than two, as was formerly required. Moreover, it also ensures the reliable operation of the machine under microprocessor control.

I claim:

1. A device for the control of the introduction of detergent into a tub of a washing machine, in particular a laundry-washing machine or a combined machine for the washing and drying of laundry, comprising at least one microprocessor controlling the action of selected operating cycles as well as a dispenser having a number of separate compartments to contain detergents or additives, the dispenser communicating with the tub and being provided with at least one rotary selector connected to a water supply of the machine and settable to each compartment of said dispense, said rotary selector being suitable to be set to different regulatory positions by means of a system of jointed levers associated with at least two box-like housings containing wax heatable by at least a relevant PTC sensor, wherein said PTC sensors (20, 21) are supplied with power by an electric circuit of the machine through a semiconductor switch such as a triac (32) or similar bidirectional conductor, and through at least a respective first and second unidirectional conductors, such as diodes (34, 35), which are biased in a mutually opposite direction.

* * * * *

UNITED STATES PATENT AND TRADEMARK OFFICE

CERTIFICATE OF CORRECTION

PATENT NO. : 5,205,445

DATED : April 27, 1993

INVENTOR(S) : Daniele Bravin

It is certified that error appears in the above-identified patent and that said Letters Patent is hereby corrected as shown below:

Column 1, line 20, delete "detergent" and insert --detergents for--.

Column 4, Claim 1, line 24, delete "dispense" and insert --dispenser--.

Signed and Sealed this

Eleventh Day of January, 1994

*Attest:*

*Attesting Officer*

BRUCE LEHMAN

*Commissioner of Patents and Trademarks*